United States Patent [19]

Lo

[11] Patent Number: 4,752,365

[45] Date of Patent: Jun. 21, 1988

[54] METHODS OF APPLICATION FOR CONDUCTIVE PRIMERS

[75] Inventor: Salvador R. Lo, Blue Island, Ill.

[73] Assignee: W. C. Richards Company, Ill.

[21] Appl. No.: 2,682

[22] Filed: Jan. 12, 1987

[51] Int. Cl.[4] ..... C25D 13/04

[52] U.S. Cl. ..... 204/181.1; 204/181.7; 204/181.6; 524/901

[58] Field of Search ..... 204/180.2, 181.1, 181.4, 204/181.6, 181.7; 118/621, 625, 627; 524/901

[56] References Cited

U.S. PATENT DOCUMENTS

| | | | |
|---|---|---|---|
| 3,408,278 | 10/1968 | Stoodley | 204/181.4 |
| 3,674,670 | 7/1972 | Erikson et al. | 204/181.1 |
| 4,477,530 | 10/1984 | Diefenbach et al. | 204/181.4 |
| 4,487,674 | 12/1984 | Jan Al et al. | 204/181.4 |

OTHER PUBLICATIONS

"Material Safety Data Sheets", Columbian Chemicals Co., 8/1/1985.
"Material Safety Data Sheets," American Cyanamid Co., 7/22/1982 and 9/9/82.
"Material Safety Data Sheets", E-M Company, 9/28/84.
"Material Safety Data Sheets", Eastman Chemical, 5/7/1985.
"Material Safety Data Sheets", Shell, 4/85.
"Material Safety Data Sheets", Hercules Inc. 10/3/1986.
"Material Safety Data Sheets", Ashland Chemical.
"Material Safety Data Sheet", Kenrich Petrochemicals.
"Material Safety Data Sheets", King Industries.
"Material Safety Data Sheet" Novamet.
"Material Safety Data Sheet" Nuddex, Inc.
"Material Safety Data Sheet" Troy Chemical Corp.

*Primary Examiner*—John F. Niebling
*Assistant Examiner*—Ben C. Hsing
*Attorney, Agent, or Firm*—Robert M. Ward

[57] ABSTRACT

The present invention is directed to improved methods for increasing the effective contact area of electrodes during the electrocoating process. One preferred embodiment of such methods comprises the first step of coating a non-conductive workpiece with a conductive primer. Next, the areas surrounding the respective contact areas for the electrocoat electrodes are coated with a contact area coating composition having greater electroconductivity then that of the conductive primer. Next, the coating electrodes are fixed on the contact areas for electrocoating. The workpiece is then submerged into an electrocoating bath, and finally sufficient electrical change is applied to the prepared workpiece to electrocoat the workpiece.

Compositions having such greater electroconductivity and which are suitable for use in the improved methods of the present invention comprise a substantially uniform dispersion of approximately 5% to 10% by weight of a polymeric binder, approximately 40% to 50% by weight of a metallic powder, approximately 38.5% to 54.5% by weight of a compatible solvent, and approximately 0.5 percent to 1.5 percent by weight of modifying agents.

28 Claims, 1 Drawing Sheet

METHODS OF APPLICATION FOR CONDUCTIVE PRIMERS

BACKGROUND OF THE INVENTION

The present invention is directed to coating methods and chemical coating compositions in general, and more particularly to improved methods for increasing the effective contact area of electrodes during electrocoating of a non-conductive workpiece which has been coated with an electroconductive primer.

In the prior art, coating methods have been devised for applying certain chemical coating compositions to non-metallic workpieces. In some instances, it has been desirable for such non-metallic workpieces to be coated in such a way to match the coatings disposed on metallic workpieces. Where electrocoating has been utilized for thesemetallic workpieces, it has been very difficult to obtain suitable color, gloss and texture matching, as well as good adhesion, chip resistance, ultra-violet light resistance, flexibility and other durability characteristics for the non-metallic workpiece.

One proposal for alleviating the problems and difficulties associated with these particular coating applications has been the development and utilization of electroconductive primer compositions which may be applied to a non-metallic workpiece, such as a polymeric workpiece. These electroconductive primers have then permitted the simultaneous electrocoating of both the non-metallic and metallic components of a combined, or composite, workpiece.

Preferred embodiments of these electrocoating methods have been developed and pioneered by the W. C. Richards Company of Blue Island, Ill. and are disclosed and claimed in patent application Ser. No. 922,318, filed on Oct. 23, 1986, entitled "Improved Conductive Primer Compositions and Methods", the disclosure and teaching of which are incorporated herein by reference.

However, one particular difficulty associated with such improved electrocoating methods has been the phenomenon of "burn-out" in areas of the electroconductive primer located adjacent to the coating electrodes. Such "burn-out" has been caused by the utilization of the necessary large electrical voltages in order to effectuate electrocoating for such large workpieces as composite automobile bumpers, large automotive panels, etc.

One suggested method of solving the "burn-out" problem has been to increase the effective area of the electrode contact by placing a metallic, and hence conductive, sheeting in contact with both the electrocoating electrode and a relatively large expanse of the electroconductive primer coated workpiece to be electrocoated. One such attempt has involved the use of aluminum foil spread over a relatively large area of the electroconductively primed workpiece immediately adjacent to the electrocoating electrode. However, these techniques have proved to involve difficulty of application, uniformity of result, problems in repeatability and inaccuracy of results, inter alia.

Accordingly, it has been a material object of the improved electrocoating methods and compositions of the present invention to materially alleviate the above difficulties and deficiencies of the prior art.

It has been a further material object of the improved electrocoating methods and compositions of the present invention to provide an increase in the effective area of the electrocoating electrode, while at the same time providing for accuracy and repeatability of results, as well as uniformity and ease of application.

It is yet further an object of the improved electrocoating methods and compositions of the present invention to provide methods utilizing highly electroconductive compositions which will form an intimate contact with electroconductive primers to facilitate the electrocoating process without experiencing the prior phenomenon of "burn-out".

It is yet further a material object of the improved electrocoating methods and compositions of the present invention to provide electroconductive coating compositions in a greater electro-conductivity than the electroconductive primer compositions per se, thereby further to facilitate the electrocoating process.

These and other material objects of the improved electrocoating methods and compositions of the present invention will become apparent to those of ordinary skill in the art upon a review of the following summary of the invention, brief description of the drawing, detailed description of preferred embodiments, the appended claims, and the accompanying drawings.

SUMMARY OF THE INVENTION

The present invention is directed to improved methods for increasing the effective contact area of electrodes during the electrocoating process.

In preferred embodiments the inventive methods hereof include the first step of coating a non-conductive workpiece with a conductive primer, such as those disclosed and claimed in the copending patent application, Ser. No. 522,318, filed on Oct. 23, 1986. Next, the area surrounding the respective contact areas for the electrocoat electrodes is coated with a contact area coating composition having greater electroconductivity than that of the conductive primer. Next, the coating electrodes are fixed on the contact areas for electrocoating. The workpiece is then submerged into an electrocoat bath, and finally sufficient electrical charge is applied to the prepared workpiece to electrocoat the workpiece.

The improved highly electroconductive compositions of the present invention may be applied by spraying or painting in some preferred embodiments.

Exemplary compositions having such greater electroconductivity and which are suitable for use in the methods of the present invention comprise a substantially uniform dispersion of approximately 5% to 10% by weight of a polymeric binder, approximately 40% to 50% by weight of a metallic powder, approximately 38.5% to 54.5% by weight of a compatible solvent, and approximately 0.5% to 1.5% by weight of various modifying agents.

In some preferred embodiments of the improved electrocoating compositions of the present invention, the binder system may comprise a combination of an epoxy resin and an alkylated amino resin. The metallic powder utilized may comprise nickel flake in some preferred embodiments. Other details of such improved methods and compositions are set forth with greater particularity, infra.

BRIEF DESCRIPTION OF THE DRAWING

Examples of apparatus for carrying out the improved electrocoating methods for utilizing the compositions of the present invention are set forth in the accompanying drawing, and in which.

DETAILED DESCRIPTION OF PREFERRED EMBODIMENTS

Figure 1:
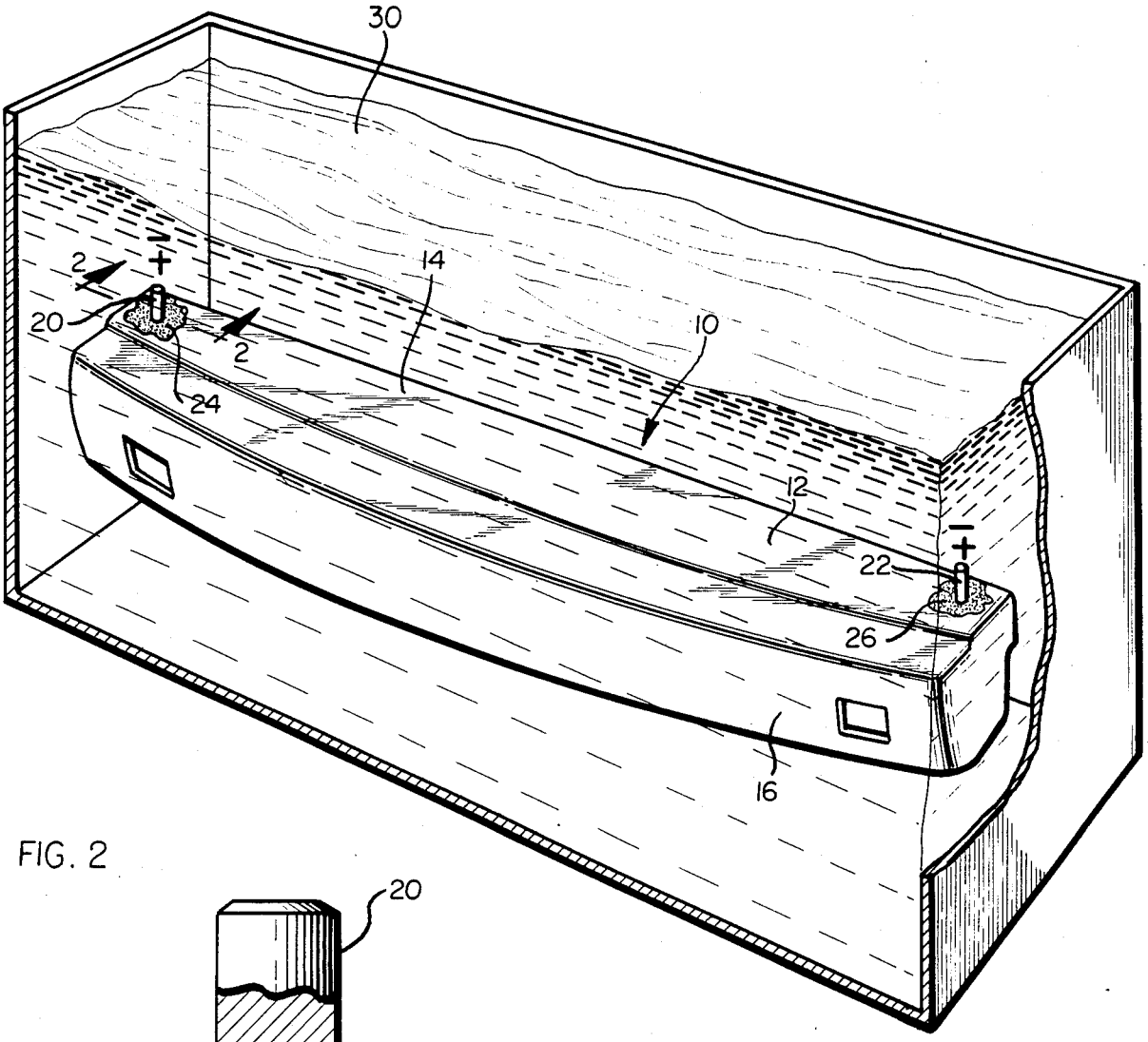
FIG. 1 is a perspective view of a polymeric automobile bumper which has been pre-coated with one of various inventive conductive primer compositions, and has had two electro-coating electrodes attached thereto, with each such electrode surrounded in the immediate vicinity thereof by a layer of the highly electroconductive compositions of the present invention.

The improved electrocoating methods of the present invention are directed, inter alia, towards increasing the effective contact area of electrodes utilized during the electrocoating process.

Exemplary embodiments of the steps of the present invention include pre-coating a non-conductive workpiece, such as e.g. an automotive bumper or an automotive panel, with a conductive primer. The workpiece may be a composite workpiece—i.e., having portions which are non-conductive and other portions which are formed preferably of metal and accordingly are conductive.

Next, the area surrounding the respective contact areas for the electrocoat electrodes on the primed workpiece is coated with a coating composition having a greater electroconductivity than that of the electroconductive primer. The electrocoating electrodes are then fixed to such contact areas for electrocoating. In other preferred embodiments, the electrodes may be fixed in place prior to the coating of such surrounding contact areas with the coating compositions of the present invention having such greater electroconductivity than that of the conductive primer which has been utilized to pre-coat the non-metallic and non-conductive portions of the workpiece.

Next, the workpiece is submerged into an electrocoat bath, and sufficient electrical charge is applied to the prepared workpiece to electrocoat such workpiece. Such final electrocoating techniques are known to those skilled in the art, and accordingly need not to set forth in detail herein.

The improved methods for increasing the effective contact area of the present invention may further comprise application of such improved compositions to the areas surrounding such electrodes by any readily available technique, such as by known spraying or by painting techniques.

The coating compositions suitable for use with the present inventive methods preferably comprise a substantially uniform dispersion of approximately 5% to 10% by weight of a polymeric binder, approximately 40% to 50% by weight of a metallic powder, approximately 38.5% to 54.5% by weight of a compatible solvent system, and approximately 0.5% to 1.5% by weight of various modifying agents. As set forth in the co-pending patent application, supra, such metallic powder is preferably added in the grind, rather than in the let-down, to provide the desired conductivity.

In one such preferred embodiment as set forth in EXAMPLE 1, infra, such compatible solvents comprise 44.9% by weight of the formulation, and such metalic powder (therein, nickel flake) comprises 44.1% by weight of the formulation.

Such improved compositions may utilize a polyester melamine binder as and for such polymeric binder. The polymeric binder may include an epoxy resin, and in preferred embodiments in an amount of approximately 1.1% by weight. Such polymeric binder may further include a alkylated amino resin, such alkylated amino resin present in an amount of 5.7% by weight in preferred embodiments.

As indicated, the metallic powder may in some embodiments comprise nickel flake. In other preferred alternative embodiments, the metallic powder may comprise powdered or flaked copper or silver. In some alternative preferred embodiments, a portion including up to approximately 25% of such metal powder may be replaced by a finely divided carbonaceous material, such as the carbon black pigment Conductex, as one such carbon black pigment which has been useful.

The compatible solvent system may comprise isobutyl alcohol, diacetone alcohol, and/or VM & P naphtha, and also ethyl 3-ethoxypropionate in some embodiments.

A thickening agent may be utilized in some such compositions, for control of rheological characteristics. Such thickening agent should be further selected towards optimization of the preferred highly electroconductive characteristics of the present invention. One such thickening agent which has been suitable has been found to be ethyl hydroxyethyl cellulose, such ethyl hydroxyethyl cellulose present in amounts of approximately 0.8% by weight.

Improved compositions useful in such inventive methods have preferably also utilized a catalyst, and an acid catalytic system is preferred. Such acid catalytic system may comprise aromatic sulfonic acid. One aromatic sulfonic acid which has been useful in particular is dinonylnaphthalene disulfonic acid.

Modifying agents which have been useful in such improved compositions have included a surfactant, with Nuosperse 700® being the preferred surfactant in certain embodiments, and present in amounts of approximately 0.6% by weight.

Other modifying agents include utilization of a organo-titanium salt, with titanium IV Bis (dioctyl) pyrophosphato-O ethylene diolato (adduct) trietylamine present in preferred embodiments. Such organo-titanium salt has been found to promote such desired characteristics of electroconductivity, and in conjunction with the surfactants and the metallic powders utilized. The organo-titanium salt may be present in preferred embodiments in amounts of 0.05% by weight. Other modifying additives may include a drier, with 16% zinc drier be preferred in some preferred embodiments, and present in amounts of approximately 0.4% by weight.

Figure 2:
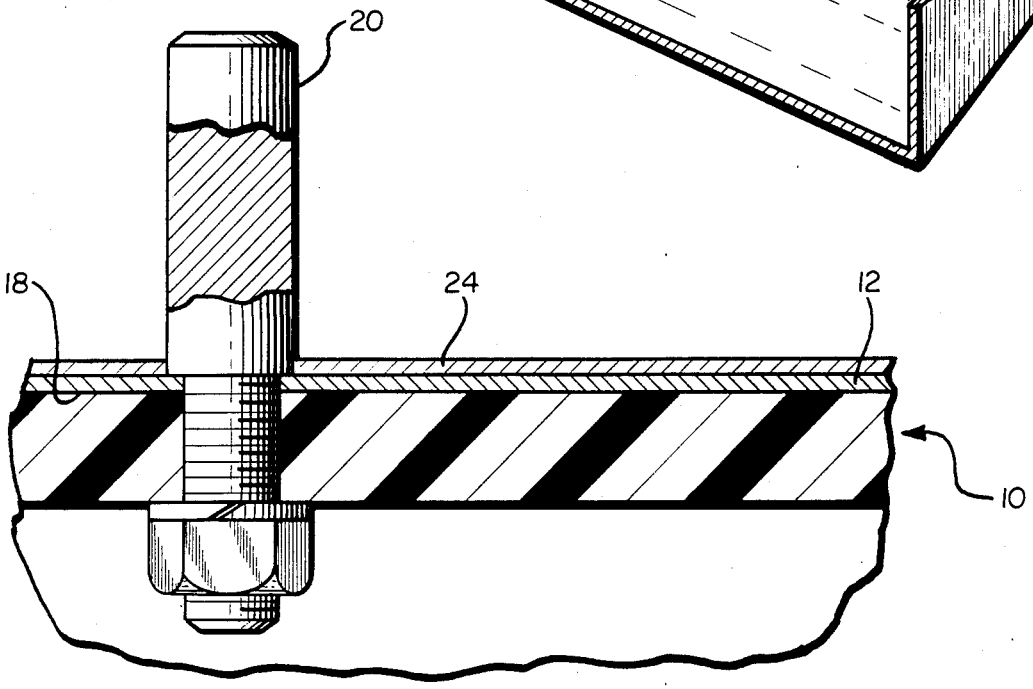
FIG. 2 is an enlarged fragmented transverse cross-sectional view taken along lines 2—2 of FIG. 1, and showing a layer of the improved highly conductive compositions of the present invention disposed upon a layer of conductive primer, which has been pre-coated upon the polymeric workpiece as shown in FIG. 1.

Referring now briefly to the drawing and to FIG. 1 in particular, certain apparatus for carryng out the improved electrocoating methods of the present invention are depicted. As discussed, supra, a non-conductive workpiece, such as an automotive bumper generally 10, as shown, is pre-coated with a layer 12 of conductive primer. The workpiece, such as the bumper 10, may be a composite workpiece having, for example, upper portions 14 which are non-conductive, and other portions, for example lower portions 16, which are formed of metal and accordingly are conductive. As shown in FIG. 2, the areas 18,18 surrounding the respective contact areas for the electrocoat anode or cathode 20 and the cathode 22 are coated with layers 24,26 of a coating composition having a greater electroconductivity than that of the electroconductive primer 12. The electrocoating electrodes 20,22 are fixed to the contact areas 18 for electrocoating by known techniques. In other preferred embodiments, the electrodes 20,22 may be fixed to place prior to the coating of such surrounding contact areas with layers 24,26 of the coating compositions of the present invention having greater electroconductivity than that of the conductive primer 12 which has been utilized to pre-coat the non-metallic and non-conductive portions 14 of such bumper workpiece 10. Next, the workpiece 10 is submerged into an electrocoat tank 28 containing an electrocoat solution 30, and sufficient electrical charge is applied to the prepared workpiece 10 to electrocoat such workpiece 10.

Preferred embodiments of the preferred highly electroconductive compositions suitable for use in performing the inventive methods thereof, are set forth in the following examples:

EXAMPLE I

The following formulation was produced according to techniques well-known to those of ordinary skill in the art. Upon testing the specific resistivity was found to be 0.4 ohm-cm.

| DESCRIPTION | WT. PERCENT | POUNDS | GALLONS | WGT. SOL. | VOL. SOL | WT. PERCENT (SOLIDS) |
|---|---|---|---|---|---|---|
| CYPLEX 1546 RESIN | 5.7% | 69.00 | 7.5000 | 48.30 | 4.7250 | 7.6% |
| EPON 828 RESIN | 1.1% | 12.97 | 1.3300 | 12.97 | 1.3300 | 2.0% |
| CYMEL 1168 RESIN | 1.6% | 18.98 | 2.0900 | 18.98 | 2.0900 | 3.0% |
| NUOSPERSE 700 SURFACTANT | 0.6% | 6.88 | .8000 | 3.44 | .3200 | 0.5% |
| KEN-REACT KR 238TG | 0.05% | .56 | .0700 | .56 | .0700 | 0.1% |
| 16% ZINC DRIER | 0.4% | 4.34 | .5106 | 3.12 | .3574 | 0.5% |
| 525 NICKEL FLAKE | 44.1% | 533.00 | 7.2222 | 533.00 | 7.2222 | 83.7% |
| ISOBUTYL ALCOHOL | 6.6% | 80.16 | 12.0000 | .00 | .0000 | — |
| VMP 66 NAPHTHA | 6.2% | 74.40 | 12.0000 | .00 | .0000 | — |
| ETHYL 3-ETHOXYPROPIONATE | 7.8% | 94.32 | 12.0000 | .00 | .0000 | — |
| EHEC X-HIGH THICKENER | 0.8% | 10.00 | 1.0718 | 10.00 | 1.0718 | 1.6% |
| ETHYL 3-ETHOXYPROPIONATE | 8.8% | 106.11 | 13.5000 | .00 | .0000 | — |
| VMP 66 | 6.4% | 76.94 | 12.4100 | .00 | .0000 | — |
| ISOBUTYL ALCOHOL | 7.5% | 90.18 | 13.5000 | .00 | .0000 | — |
| DIACETONE ALCOHOL (AF) | 1.6% | 19.55 | 2.5000 | .00 | .0000 | — |
| NACURE 155 ACID CATALYST | 1.0% | 12.24 | 1.5000 | 6.73 | .7350 | 1.1% |
| TOTAL | 100.25% | 209.63 | 100.00 | 637.09 | 17.9214 | 100.1% |
| PIGMENT SOLIDS | | | 533.00 | 7.2222 | | |
| VEHICLE SOLIDS: | | | 90.25 | 9.2168 | | |
| PVC: 40.30% | | | | | | |
| SOLIDS BY WGT: 52.67% | | | | | | |
| SOLIDS BY VOL: 17.92% | | | | | | |
| VOC (LB/GL): 5.72% | | | | | | |
| SQ. FT. COVERAGE (1 MIL): 287 | | | | | | |

EXAMPLE 2

Three test panels were coated with conductive coatings in preparation for testing of the efficacy of the coating compositions of the present invention. On Panel A no means were used to increase the effective size of the electrode. On Panel B a metal plate was disposed flatly the test panel in order to increase the effective size of the electrode. In test Panel C, the coatings hereof were utilized to increase the effective area of the electrode. The resistance between electrodes was measured in each case, with the following results.

| Test Panel | Resistance |
|---|---|
| Panels A | 0.964 kilo ohms |

-continued

| Test Panel | Resistance |
|---|---|
| Panels B | 0.516 kilo ohms |
| Panels C | 0.445 kilo ohms |

EXAMPLE III

The following ingredients from the following sources are preferred for use in the novel compositions hereof, although equivalent ingredients from other sources may be utilized.

| COMPONENT | NAME OF THE COMPANY | ADDRESS |
|---|---|---|
| CONDUCTEX 40-220 | Columbian Chemicals Co. | P. O. Box 37 Tulsa, OK 74102 |
| CYMEL 1168 RESIN | American Cyanamid Co. | Wayne, New Jersey 07470 |
| CYPLEX 1546 Resin | American Cyanamid Co. | Wayne, New Jersey 07470 |
| DIACETONE ALCOHOL | E-M Company | Box 822 North Chicago, IL. |
| EKTAPRO EEP SOLVENT | Eastman Chemical Products, Inc. | Kingsport, Tennessee |
| EPON RESIN 828 | Shell Oil Company | Product Safety Co. P.O. Box 4320 Houston, TX 77210 |
| ETHYL HYDROXY ETHYL CELLULOSE | Hercules Incorporated | Hercules Plaza Wilmington, Delaware 19894 |
| ISOBUTYL ALCOHOL | Ashland Chemical | P.O. Box 2219 Columbus, Ohio 43216 |
| KEN-REACT KR 238TG ORGANO-TITANIUM SALT | Kenrich Petrochemicals | 140 E. 22nd Bayonne, NJ 07002-0032 |
| NACURE 155 ACID CATALYST | King Industries, Inc. | Science Road Norwalk, CT. 06852 |

-continued

| COMPONENT | NAME OF THE COMPANY | ADDRESS |
|---|---|---|
| 525 NOVAMET NICKEL FLAKE | Novamet | 681 Lawlins Road Wyckoff, N.J. 07481 |
| NUOSPERSE 700 Surfactant | Nuddex, Inc., Inc. | Turner Place P.O. Box 365 Piscataway, N.J. 08854 |
| TROYMAX ZINC DRIER 16% | Troy Chemical Corp. | One Avenue L Newark, N.J. 07105 |
| VMP 66 NAPHTHA | Ashland Chemical | P.O. Box 2219 Columbus, Ohio 43216 |

The basic and novel characteristics of the improved methods and compositions of the present invention will be readily understood from the foregoing disclosure by those skilled in the art. It will become readily apparent that various changes and modifications may be made in the ingredients, form, construction and arrangement of the improved methods and compositions of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved method for increasing the effective contact area of electrodes during electrocoating, comprising the steps of:

coating a non-conductive workpiece with a conductive primer;

coating the area surrounding the respective contact areas for the electrocoat electrodes with a contact area coating composition having greater conductivity than that of the conductive primer;

fixing the electrocoating electrodes to said contact areas for electrocoating;

submerging the workpiece into an electrocoat bath; and applying sufficient electrical charge to the conductive primed and contact area coated workpiece to electrocoat said workpiece.

2. The improved method for increasing the effective contact area of electrodes during electrocoating as claimed in claim 1 wherein the area surrounding the respective contact areas for the electrodes is coated with said contact area coating composition by spraying said contact area coating composition thereonto.

3. The improved method for increasing the effective contact area of electrodes during electrocoating as claimed in claim 1 wherein the area surrounding the respective contact areas for the electrodes is coated with said contact area coating composition by painting said contact area coating composition thereonto.

4. The improved method for increasing the effective contact area of electrodes during electrocoating as claimed in claim 1 wherein said contact area coating composition comprises a grind of substantially uniform dispersion of:

approximately 5% to 10% by weight of a polymeric binder;

approximately 40% to 50% by weight of a metallic powder;

approximately 38.5% to 54.5% by weight of a compatible solvent; and approximately 0.5% to 1.5% by weight of modifying agents.

5. The improved method for increasing the effective contact area of electrodes during electrocoating as claimed in claim 4 wherein the polymeric binder comprises a polyester melamine binder.

6. The improved method for increasing the effective contact area of electrodes during electrocoating as claimed in claim 5 wherein the polymeric binder further comprises an epoxy resin.

7. The improved method for increasing the effective contact area of electrodes during electro-coating as claimed in claim 6 wherein the epoxy resin is present in an amount of approximately 1% by weight of the contact area coating composition.

8. The improved method for increasing the effective contact area of electrodes during electrocoating as claimed in claim 5 wherein said polymeric binder further comprises an alkylated amino resin.

9. The improved method for increasing the effective contact area of electrodes during electro-coating as claimed in claim 8 wherein said alkylated amino resin is present in an amount of approximately 5.7% by weight of the contact area coating composition.

10. The improved method for increasing the effective contact area of electrodes during electrocoating as claimed in claim 4 wherein the metallic powder comprises nickel flake.

11. The improved method for increasing the effective contact area of electrodes during electrocoating as claimed in claim 4 wherein the metallic powder is selected from the group consisting of finely divided nickel, copper, and silver.

12. The improved method for increasing the effective contact area of electrodes during electrocoating as claimed in claim 4 wherein the compatible solvent comprises isobutyl alcohol.

13. The improved method for increasing the effective contact area of electrodes during electrocoating as claimed in claim 4 wherein the compatible solvent comprises diacetone alcohol.

14. The improved method for increasing the effective contact area of electrodes during electrocoating as claimed in claim 4 wherein the compatible solvent comprises ethyl 3-ethoxypropionate.

15. The improved method for increasing the effective contact area of electrodes during electro-coating as claimed in claim 4 wherein said contact area composition further comprises a thickening agent.

16. The improved method for increasing the effective contact area of electrodes during electrocoating as claimed in claim 15 wherein the said thickening agent comprises ethyl hydroxyethyl cellulose.

17. The improved method for increasing the effective contact area of electrodes during electro-coating as claimed in claim 16 wherein the ethyl hydroxyethyl cellulose is present in an amount comprising approximately 0.8% by weight of the contact area coating composition.

18. The improved method for increasing the effective contact area of electrodes during electrocoating as claimed in claim 4 wherein said contact area coating composition further comprising an acid catalyst.

19. The improved method for increasing the effective contact area of electrodes during electrocoating as claimed in claim 18 wherein the acid catalyst comprises an aromatic sulfonic acid.

20. The improved method for increasing the effective contact area of electrodes during electrocoating as claimed in claim 19 wherein the aromatic sulfonic acid comprises dinonylnaphthalene disulfonic acid.

21. The improved method for increasing the effective contact area of electrodes during electrocoating as claimed in claim 4 wherein said modifying agents comprise at least one surfactant.

22. The improved method for increasing the effective contact area of electrodes during electrocoating as claimed in claim 4 wherein the modifying agents comprise an organo-titanium salt.

23. The improved method for increasing the effective contact area of electrodes during electrocoating as claimed in claim 22 wherein the organo titanium salt comprises titanium IV bis (dioctyl) pyrophosphato-O ethylene diolato (adduct) triethylamine.

24. The improved method for increasing the effective contact area of electrodes during electro-coating as claimed in claim 22 wherein the organo-titanium salt is present in an amount of approximately 0.05% by weight of the contact area coating composition.

25. The improved method for increasing the effective contact area of electrodes during electrocoating as claimed in claim 4 wherein the modifying agents comprise a drier.

26. The improved method for increasing the effective contact area of electrodes during electrocoating as claimed in claim 25 wherein the drier comprises 16% zinc drier.

27. The improved method for increasing the effective contact area of electrodes during electrocoating as claimed in claim 26 wherein the 16% zinc drier is present in an amount of 0.4% by weight of the contact area coating composition.

28. The improved method for increasing the effective contact area of electrodes during electrocoating as claimed in claim 4 wherein the metal powder is incorporated into said substantially uniform dispersion in the grind.

* * * * *